US010202846B2

(12) United States Patent
Chemali et al.

(10) Patent No.: US 10,202,846 B2
(45) Date of Patent: Feb. 12, 2019

(54) STONELEY WAVE BASED PIPE TELEMETRY

(71) Applicant: Halliburton Energy Services, Inc., Houston, TX (US)

(72) Inventors: Roland E. Chemali, Humble, TX (US); Ronald Dirksen, Spring, TX (US); Paul F. Rodney, Spring, TX (US); Arthur C. H. Cheng, Houston, TX (US); Tianrun Chen, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/531,597

(22) PCT Filed: Feb. 10, 2015

(86) PCT No.: PCT/US2015/015200

§ 371 (c)(1),
(2) Date: May 30, 2017

(87) PCT Pub. No.: WO2016/130111

PCT Pub. Date: Aug. 18, 2016

(65) Prior Publication Data

US 2018/0283172 A1 Oct. 4, 2018

(51) Int. Cl.

| | |
|---|---|
| ***E21B 47/14*** | (2006.01) |
| ***E21B 47/16*** | (2006.01) |
| ***E21B 47/18*** | (2012.01) |

(52) U.S. Cl.

CPC ..... *E21B 47/16* (2013.01); *E21B 47/14* (2013.01); *E21B 47/18* (2013.01)

(58) Field of Classification Search

None

See application file for complete search history.

(56) References Cited

U.S. PATENT DOCUMENTS

| | | | | |
|---|---|---|---|---|
| 5,222,049 A | | 6/1993 | Drumheller | |
| 5,687,138 A | | 11/1997 | Kimball et al. | |
| 6,023,445 A | * | 2/2000 | Cook | E21B 47/042 340/854.3 |
| 6,614,360 B1 | | 9/2003 | Leggett et al. | |

(Continued)

FOREIGN PATENT DOCUMENTS

WO WO 2014/138963 A1 9/2014

OTHER PUBLICATIONS

International Search Report and the Written Opinion of the International Search Authority, or the Declaration, Oct. 30, 2015, PCT/US2015/015200, 16 pages, ISA/KR.

*Primary Examiner* — Thomas S McCormack
(74) *Attorney, Agent, or Firm* — Haynes and Boone, LLP

(57) ABSTRACT

A downhole telemetry well system transmits data at a high rate inside a tubular pipe by encoding signals on a Stoneley wave. Telemetry devices for the Stoneley mode are implemented in short pipe joints inserted at various intervals between the tubulars. Each telemetry device includes Stoneley transducers, which may act as a transmitter, receiver, or repeater. The Stoneley telemetry devices transmit and receive the Stoneley waves making up the carrier of the signal. The Stoneley telemetry devices may be powered by on-board batteries or via some remote power source.

21 Claims, 15 Drawing Sheets

(56) References Cited

U.S. PATENT DOCUMENTS

| | | | | |
|---|---|---|---|---|
| 6,970,099 | B2 | 11/2005 | Koro | |
| 7,348,892 | B2 | 3/2008 | Rodney | |
| 7,894,300 | B2 | 2/2011 | Hawthorn et al. | |
| 7,970,544 | B2 | 6/2011 | Tang et al. | |
| 8,238,194 | B2 | 8/2012 | Wu et al. | |
| 8,242,928 | B2 | 8/2012 | Prammer | |
| 8,242,929 | B2 | 8/2012 | Vornbrock | |
| 8,833,472 | B2 | 9/2014 | Hay | |
| 2006/0002232 | A1 | 1/2006 | Shah et al. | |
| 2006/0221768 | A1* | 10/2006 | Hall | G01V 1/40 367/82 |
| 2008/0007421 | A1 | 1/2008 | Liu et al. | |
| 2010/0182161 | A1 | 7/2010 | Robbins et al. | |
| 2011/0018734 | A1 | 1/2011 | Varveropoulos et al. | |
| 2011/0205847 | A1 | 8/2011 | Lemenager | |
| 2012/0068712 | A1* | 3/2012 | Taherian | G01V 1/282 324/338 |
| 2012/0125686 | A1 | 5/2012 | Hogseth et al. | |
| 2012/0273270 | A1* | 11/2012 | Rasheed | E21B 44/005 175/24 |
| 2013/0125641 | A1* | 5/2013 | Chemali | E21B 47/00 73/152.47 |
| 2013/0241742 | A1* | 9/2013 | Contant | G01V 3/30 340/854.6 |
| 2014/0055279 | A1 | 2/2014 | Hay | |
| 2014/0160890 | A1 | 6/2014 | Fang et al. | |
| 2014/0192621 | A1 | 7/2014 | Ram et al. | |

* cited by examiner

STONELEY WAVE BASED PIPE TELEMETRY

PRIORITY

The present application is a U.S. National Stage patent application of International Patent Application No. PCT/US2015/015200, filed on Feb. 10, 2015, the benefit of which is claimed and the disclosure of which is incorporated herein by reference in its entirety.

FIELD OF THE DISCLOSURE

The present disclosure generally relates to downhole communications and, more particularly, to a system and method using Stoneley waves for downhole telemetry.

DESCRIPTION OF ILLUSTRATIVE EMBODIMENTS

Illustrative embodiments and related methods of the present disclosure are described below as they might be employed in a well system and method for Stoneley wave based pipe telemetry. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As described herein, the present disclosure is directed to systems and methods for conducting downhole telemetry operations using Stoneley wave carrier signals. In a generalized embodiment, a plurality of Stoneley wave telemetry devices are positioned along a tubular string. The Stoneley wave telemetry devices may be implemented as a transmitter, receiver, or repeater. Each Stoneley wave telemetry device includes a plurality of transducers used to transmit and/or receive the Stoneley waves. During a telemetry operation, the Stoneley wave transducers perform an uplink or downlink communication of Stoneley waves between one another.

Figure 1A:
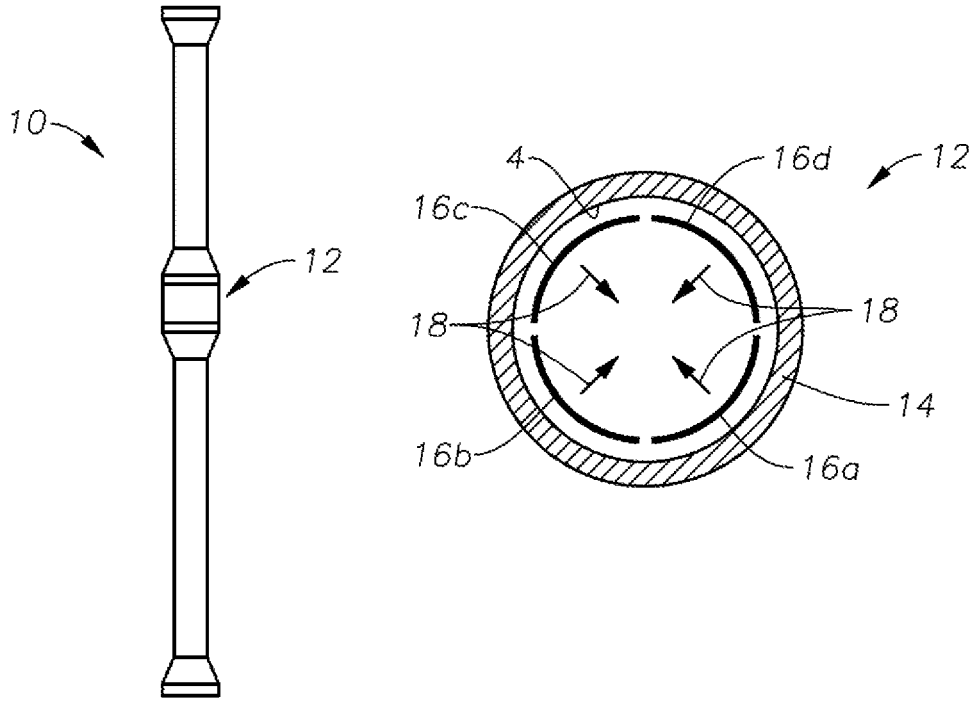
FIG. 1A illustrates a section of a tubular string having a Stoneley wave telemetry device, according to certain illustrative embodiments of the present disclosure.

FIG. 1A illustrates a section of a tubular string having a Stoneley wave telemetry device, according to certain illustrative embodiments of the present disclosure. Note that only one Stoneley wave telemetry device is shown for simplicity, although two or more telemetry devices may be utilized in the embodiments described herein. As shown in FIG. 1A, a downhole well system transmits data inside a tubular 10 by encoding signals on a carrier of Stoneley mode acoustic waves traveling in the tubular filled with drilling fluid. Tubular 10 may comprise part of any number of tubular strings including, for example, a drilling, logging, or logging-while-drilling ("LWD") string. Although not shown in FIG. 1A, tubular 10 is positioned along a borehole extending within a formation.

In this illustrative embodiment, Stoneley wave telemetry device 12 is implemented in short pipe joints (e.g., drill collars) inserted at various intervals between the tubular/pipe joints. Each Stoneley wave telemetry device 12 may act as a transmitter, receiver, or transceiver to achieve uplink or downlink communications. However, for the following description, telemetry device will be described as a transmitter or receiver (not a transceiver). When acting as a transceiver, telemetry device 12 is referred to herein as a "repeater." Stoneley wave telemetry devices 12 are axially separated from one another. In certain embodiments, the distance between the Stoneley wave telemetry devices may be a distance of 10-40 meters, thus qualifying the system as a short hop telemetry system.

Each Stoneley wave telemetry device 12 includes a tubular housing 14, and transducers 16*a-d* acting as Stoneley wave transmitters or receivers spatially separated from each other radially in symmetrical pairs orthogonal to the axis of repeater 12, thus forming a transmitter-receiver pair. Stoneley wave telemetry device 12 may also include elements to attenuate, reflect or direct the Stoneley waves. As will be described in more detail below, the Stoneley wave transmitter/receiver pairs can also be repeater pairs that are spatially separated along the axis of the tubular 10, so as to extend the distance over which signals can be telemetered and/or to provide bimodal communication capability. Stoneley telemetry device (s) 12 transmit(s) and receive(s) the Stoneley waves making up the carrier of the signal. Stoneley telemetry device 12 may be powered by on-board batteries or via some remote power source (not shown).

In certain illustrative embodiments, Stoneley telemetry device 12 is made of a plurality of transducers 16*a-d*, which may be azimuthally distributed piezo-electric or magnetostrictive (consisting of a material such as terfenol) elements mounted on inner wall 4 of tubular housing 14. In other words, transducers 16*a-d* are radially separated from one another in symmetrical pairs orthogonal to the axis of telemetry device 12. Although four transducers are shown, more or less transducers may be utilized in any of the embodiments described herein. During operation of certain embodiments, transducer elements 16*a-d* are fired in a synchronized fashion (to transmit) or receive the Stoneley signals in a synchronized fashion.

After firing, the Stoneley wave(s) travel inside tubular 10 to the next Stoneley wave telemetry device 12 where it is detected and re-launched. One advantage of the Stoneley telemetry device 12 is that any lateral noise 18 will be automatically cancelled by subtracting signals from opposing transducers 16*a-d*, which is why they are positioned in opposite orientation with respect to one another, as previously described. One advantage of using Stoneley waves, as compared to other sonic modes, is that Stoneley waves typically have the least attenuation of the acoustic modes, especially in steel pipe. Another advantage is that Stoneley waves can readily be generated that have amplitudes that are higher than the amplitudes of other acoustic modes.

Figure 1B:
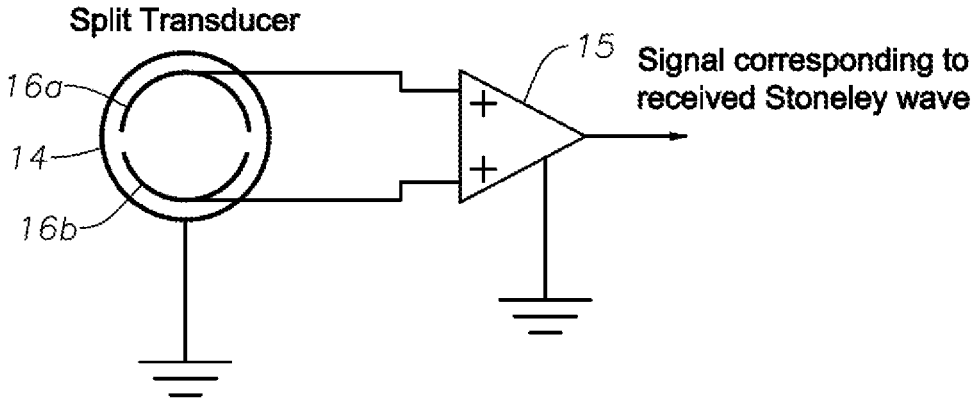
FIGS. 1B-1D illustrate various circuits for receiving Stoneley waves with symmetrically opposed transducers, according to certain illustrative embodiments of the present disclosure.

FIG. 1B shows an example of a circuit for receiving Stoneley waves with a pair of symmetrically opposed transducers, according to illustrative embodiments of the present disclosure. The principle of operation is as follows: A Stoneley wave will exert the same pressure with the same sign on both transducers 16*a* and 16*b*, while a cross-axial shock to the tubular housing 14 will induce noise of approximately equal and opposite sign in the two elements. By directing the outputs to a summing amplifier 15 that has a ground in common with tubular housing 14 (i.e., the housing for the transducers), the Stoneley wave component of the signal received by transducers 16*a,b* is summed, while the noise induced by shock is approximately canceled.

Figure 1C:
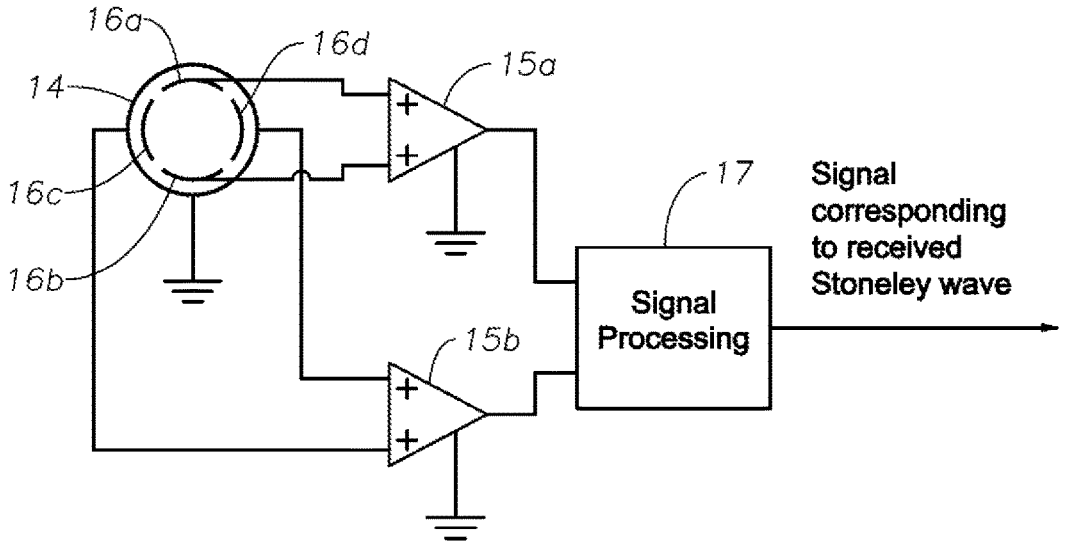

Referring now to FIG. 1C, a more sophisticated arrangement is shown for receiving Stoneley waves. In this case, two pairs of diagonally opposed transducers 16*a,b* and 16*c,d* are used to form a transmitter. The same circuit as in FIG. 1B is duplicated for each pair of transducers 16*a,b* and 16*c,d*, whereby their outputs are fed into amplifier 15*a* and 15*b*, respectively. In addition, the outputs of the transducers 16*a,b* are fed to a signal processing circuit 17. The signal processing circuit 17 may include one or more analog to digital to converters. If there is only one analog to digital converter, then a multiplexer must be included for switching between the two signals, and the multiplexer must be switched between the two inputs from the pairs of transducers 16*a,b* at a sufficient rate that the relative time shift between samples of the transducer pairs does not significantly degrade the processed signal.

Still referring to FIG. 1C, signal processing can be as simple as summing the outputs of the two pairs of transducers. More generally, signal processing may include selecting the signal from one of the pairs of transducers as a cleaner representation of the Stoneley wave than the signal from the other pair of transducers. This can be accomplished using a knowledge of the frequency band of the Stoneley wave telemetry signal and noting Signal power in that frequency band relative to power outside of that band in the signals from each of the transducer pairs and, for each pair, taking the ratio of these powers as a measure of the signal to noise ratio. The signal with the highest signal to noise ratio is selected from the processing module.

Figure 1D:
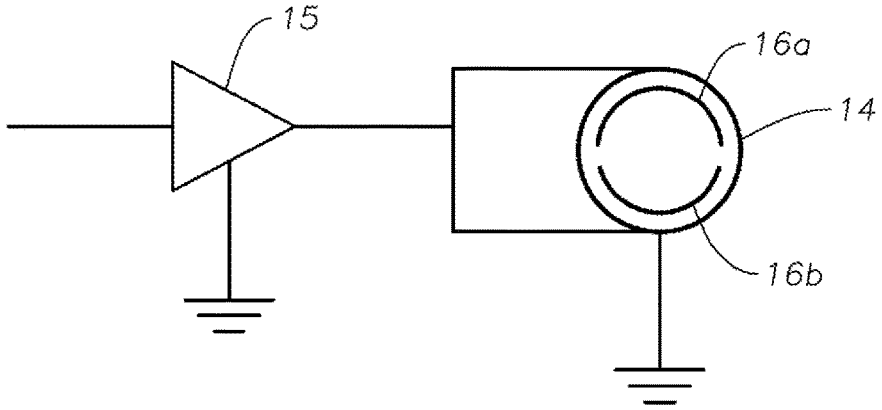

A suitable arrangement for transmitting Stoneley waves is shown in FIG. 1D. An amplifier 15 drives a pair of symmetrically disposed transducers 16*a,b* with the same signal. The amplifier shares a common ground with tubular housing 14 (i.e. the housing for the transducers). If there are more than two transducers, they should all be driven with the same signal relative to the drill collar. Moreover, switching between transmitting and receiving can be accomplished using electronic switches and control logic (e.g, signal conditioners and control modules), as described later in this disclosure.

Figure 2A:
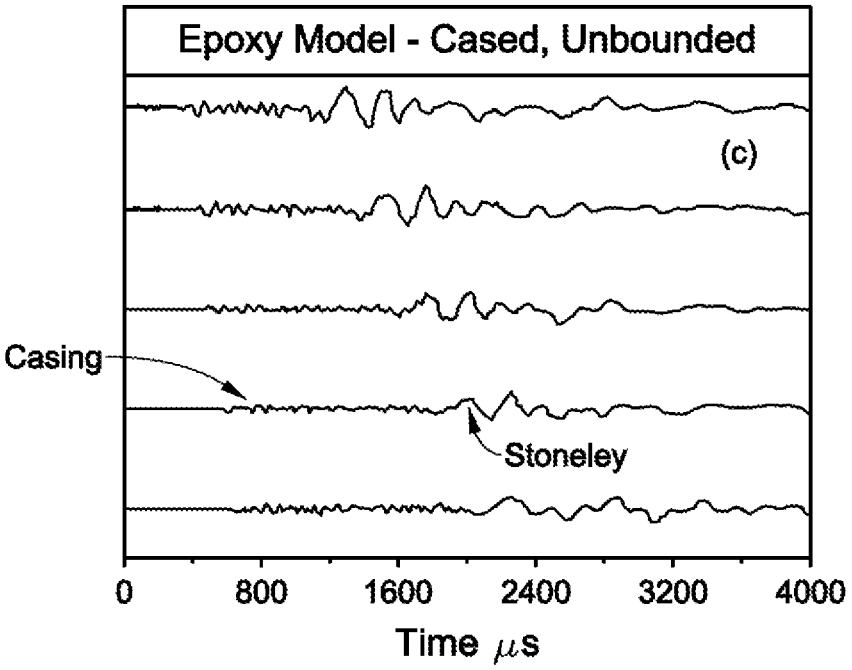
FIGS. 2A and 2B illustrate the large amplitude of the Stoneley waves in a cased borehole.
Figure 2B:
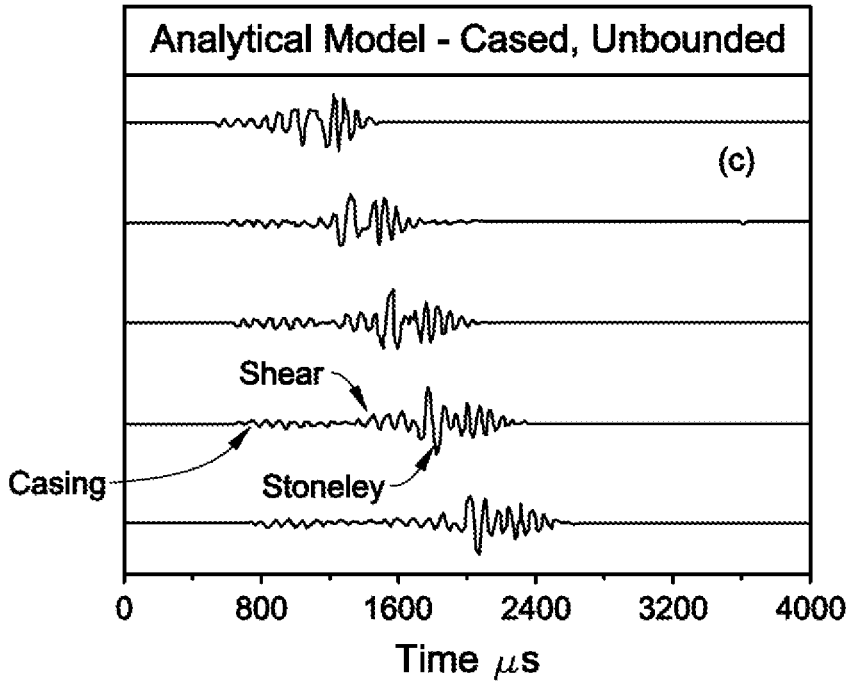

Adaptable to standard suites of tubulars/pipe, the illustrate embodiments described herein require less dedicated capital investment and less logistics than wired pipes. The illustrative telemetry systems rely on Stoneley waves which are stronger and carry further than compressional or shear waves in the same range of frequencies. As shown in FIG. 1, the Stoneley waves are made by wall mounted transducers 16*a-d*, leaving the center of the tubular housing 14 open for mud flow and for intervention. FIGS. 2A and 2B, taken from "A Study of Sonic Logging in a Cased Borehole," S. K. Chang, A. H. Everhart, Journal of Petroleum Technology, Society of Petroleum Engineers of AIME, pp 1745-1750, September, 1983 illustrate the large amplitude of the Stoneley waves in an open borehole with no casing. Note, however, that the embodiments described herein are not limited to uncased-holes; rather, the graphs of FIGS. 2A and 2B are used to illustrate the strength of the Stoneley wave as it propagates within a steel tubular.

FIGS. 2A and 2B are microseismograms of signal amplitudes in a scaled physical model (2A) and analytical model (2B) of a cased borehole with poor bonding between the casing and the borehole. The formation is a mixture of epoxy and sand as described in Chang and Everhart. The seismograms were obtained by observing the outputs of five different acoustic sensors mounted along a cable with a constant separation between the sensors. The vertical scale is proportional to the physical separation between the sensors while the horizontal scale is time (the sensors are about 3 inches apart). The observed signal amplitude is also plotted as a vertical coordinate with the same sensitivity for each trace. The acoustic source had appreciable power between 20 KHz and 50 KHz. It is quite evident from this figure that the Stoneley component is much stronger than the shear and casing components, while the compressional component is not even visible.

Figure 3:
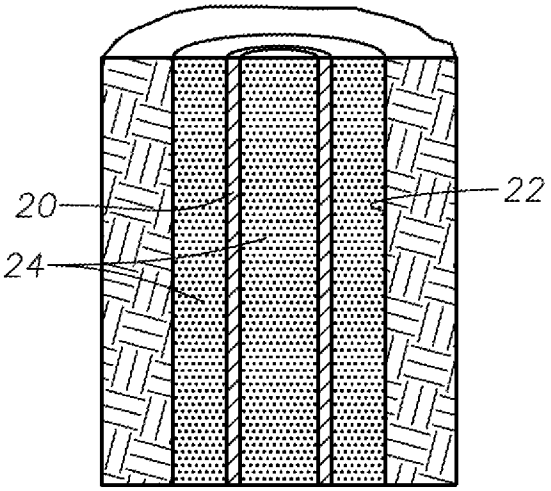
FIG. 3. illustrates a steel mandrel positioned inside a borehole filled with drilling fluid, which was modeled during a study conducted to determine how Stoneley waves inside a mandrel attenuate with mud properties.

A modeling study was conducted to determine how Stoneley waves inside a mandrel attenuate with mud properties. In the study, the attenuation and dispersion of low frequency (between 5 Hz to 100 Hz) Stoneley waves propagating in a borehole with viscous fluid (drilling mud) and a steel mandrel were analyzed. FIG. 3 illustrates such a modeling scenario. Here, a steel mandrel is shown positioned inside a borehole 22 along a formation, borehole 22 being filled with drilling fluid 24.

Figure 4:
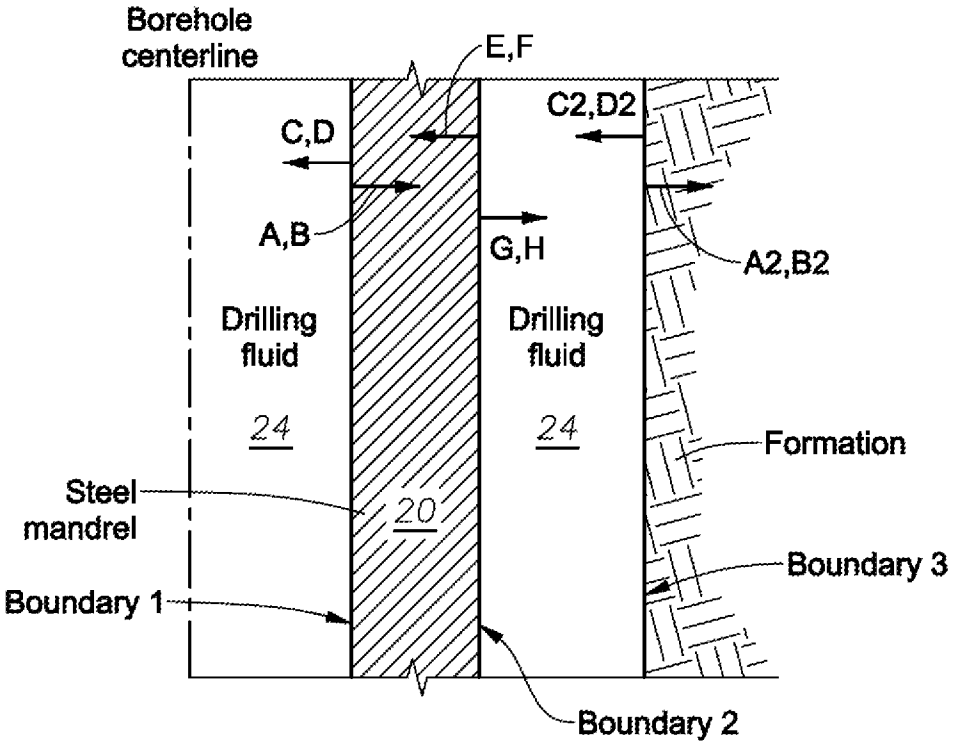
FIG. 4 illustrates boundary conditions used during the modeling study.

During the study, a coefficient matrix M (12×12) was generated with boundary conditions at three different boundaries. The boundaries were between the inner fluid 24 and inner surface of steel mandrel 20 (1); between the outer surface of steel mandrel 20 and outer fluid 24 (2); and between outer fluid 24 and the formation (3), as shown in FIG. 4. Four boundary conditions were satisfied at these boundaries: (1) Continuity of radial displacement, (2) Continuity of radial stress, (3) Continuity of axial displacement, and (4) Continuity of axial stress.

After the coefficient matrix is generated, the axial wavenumber was calculated. The fluid sound velocity and density were 1500 m/s and 1000 kg/m^3, respectively. The compressional (p), shear velocity (s) and density of steel mandrel were 5600 m/s, 3000 m/s and 7800 kg/m^3. The compressional (p), shear velocity (s) and density of formation were 3670 m/s, 2170 m/s and 2400 kg/m^3. The inner and outer diameters of steel mandrel 20 were 4.276 and 7 inch, respectively. The radius of borehole 22 was 9 inches. The dynamic viscosity of the drilling fluid was then calculated.

Figure 5:
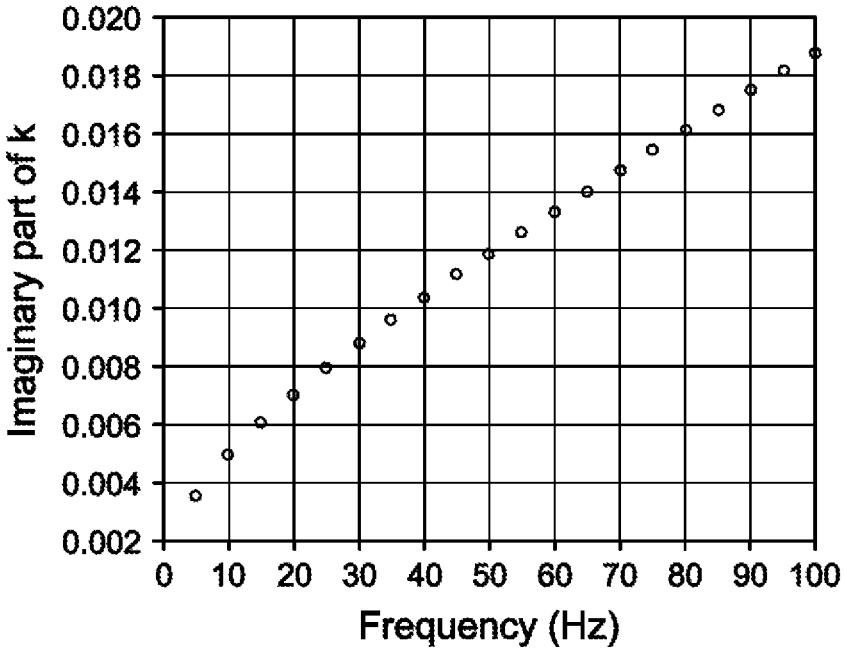
FIGS. 5 and 6 show the results of the modeling.
Figure 6:
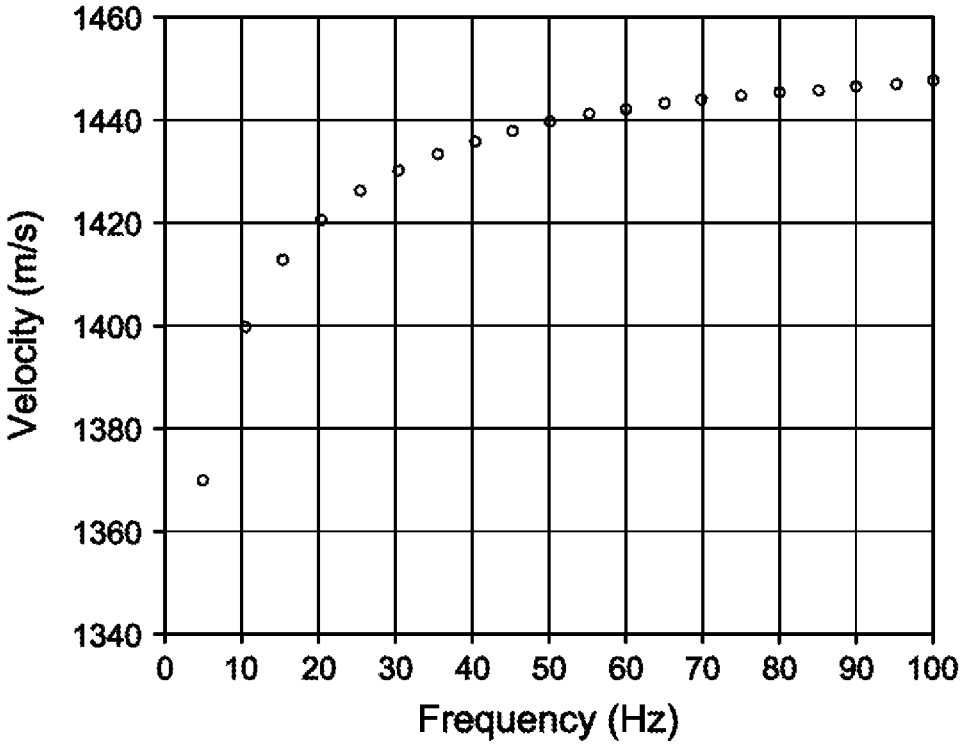

FIGS. 5 and 6 show results of the modeling. In FIG. 5, the imaginary part of the axial wavenumber k versus frequency for fluid-steel-fluid-formation models is shown. FIG. 6 shows the velocity versus the frequency. The models reflect Stoneley waves of a steel pipe containing fluid that is centered in a fluid-containing borehole through a formation. Knowledge of the real and imaginary part of the wave number allows one to model the signal propagation over a variety of assumed embodiments with various reflectors. The wave speed is the radian frequency divided by the real part of the wave number, so it is possible to get all of the information needed to analyze a Stonely wave telemetry system from the imaginary part of the wave number and the wave speed; The imaginary part of the wave number is related to the real part of the wave number and the Q (to be defined shortly) as follows:

$$ki[\omega]=kr[\omega]/(2*Q[\omega]), \quad \text{Eq. (1),}$$

Alternatively, the imaginary part of the wave number is related to the velocity by:

$$ki[\omega]=\omega/(2*Q[\omega]*v[\omega]), \quad \text{Eq. (2).}$$

In Equations 1-2, ω is the frequency (radian frequency), kr is the real part of the wave number, ki is the imaginary part of the wave number, v is velocity, [ω] is used to indicate that a variable is a function of ω. The attenuation provides an indication of how far a signal can be propagated. The Q is defined as:

$$Q[\omega]=-(1/\pi)(\Delta A[\omega]/A[\omega]), \quad \text{Eq. (3)}$$

where A[ω] is the amplitude of the wave at frequency ω, and AA[ω] is the change in amplitude as the wave propagates one cycle. Once kr and ki are known, wave propagation characteristics with various types of reflectors may be calculated, as will be needed to model propagation in a drillstring since there is a change in diameter at every tool joint. In general, one would need to know kr and ki not only as a function of frequency, but as a function of the inner diameter of the pipe, the outer diameter of the pipe, the diameter of the borehole, the speed of sound in the pipe and the speed of sound in the drilling mud. However, there is little variation in the propagation properties for a system with any range of inner and outer pipe diameters and borehole sizes realizable in the drilling environment as long as the pipe is uniform.

The studies reported above were useful for obtaining a preliminary understanding of the capabilities of a Stoneley wave telemetry system, in accordance to the illustrative embodiments of the present disclosure. A deeper understanding was obtained when a similar analysis was carried out to a frequency of 20 KHz, and detailed calculations were made of transmission and reflection when pipe joints or other disturbances in the cross-section of the pipe were included.

Figure 7:
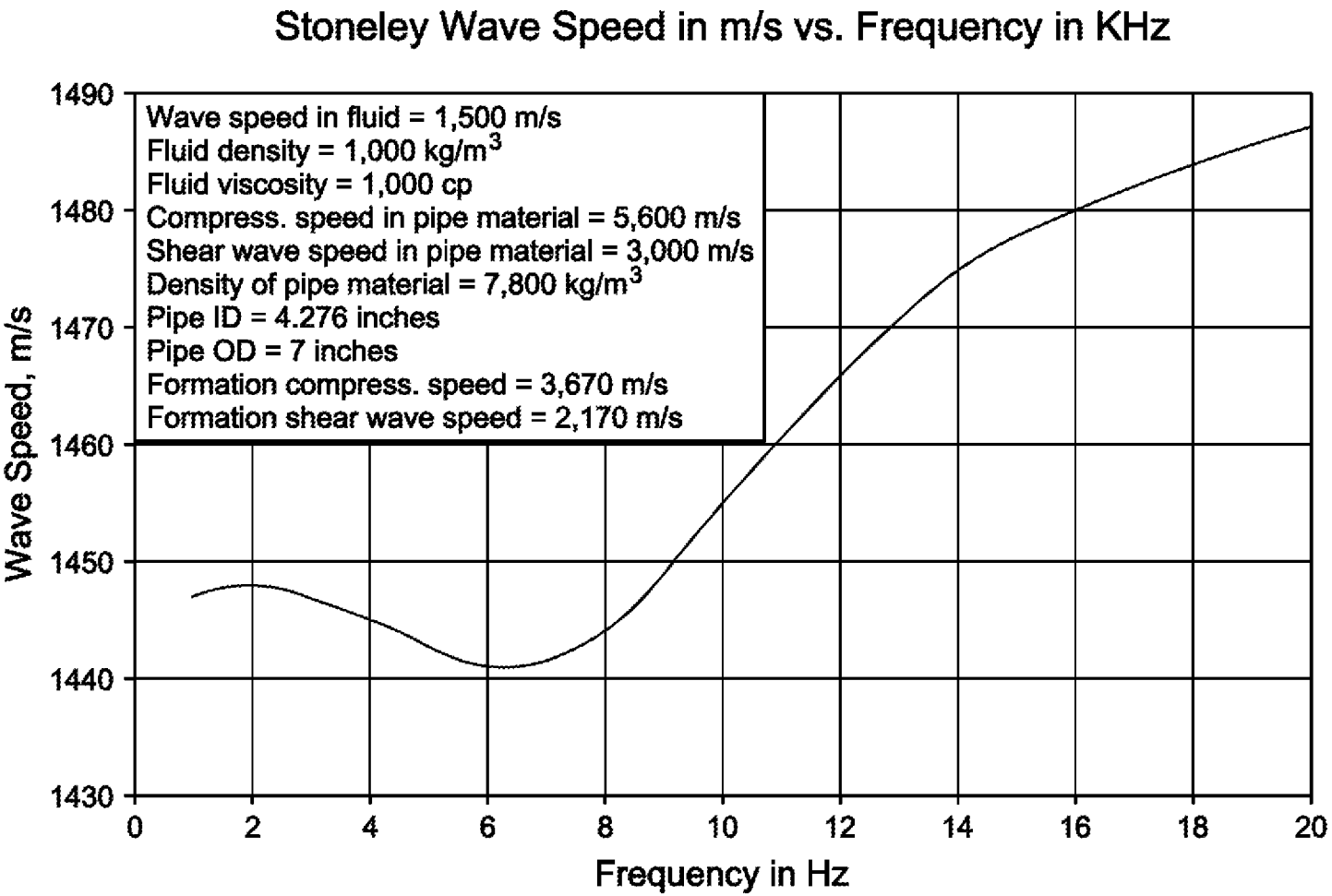
FIG. 7 is a graph illustrating Stoneley wave speed for a pipe, according to certain embodiments of the present disclosure.
Figure 8:
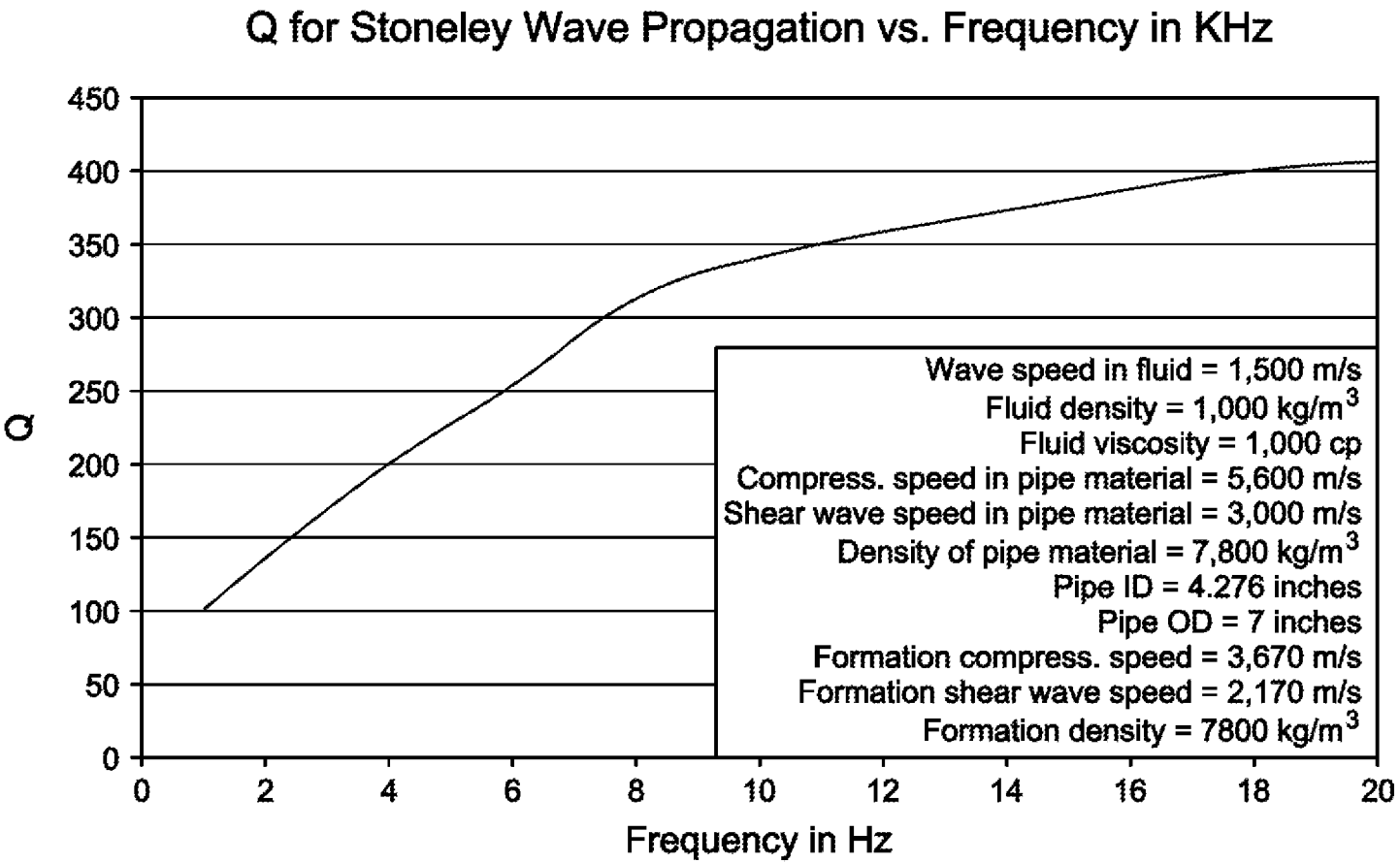
FIG. 8 is a graph illustrating the Q (Equation 3) for Stoneley wave propagation, according to certain illustrative embodiments of the present disclosure.

FIGS. 7 and 8 are graphs illustrating the Stoneley wave speed and Q for Stoneley wave propagation, respectively, for various tubulars, according to certain embodiments of the present disclosure. FIG. 7 shows the Stoneley wave speed in meters per second between 1 KHz and 20 KHz frequencies for a drill pipe in a borehole with the properties indicated in the legend. These properties include: a wave speed in fluid=1,500 m/s; fluid density=1,000 kg/m$^3$; fluid viscosity=1,000 cp; Compression speed in pipe material=5,600 m/s; Shear wave speed in pipe material=3,000 m/s; Density of pipe material=7,800 kg/m$^3$; Pipe ID=4.276 inches; Pipe OD=7 inches; Formation compression speed=3,670 m/s; and Formation shear wave speed=2,170 m/s. FIG. 8 shows the Q of Stoneley wave propagation under the same conditions.

The plots of FIGS. 7 and 8 are somewhat irregular due to numerical difficulties with the model. Similarly, some of the parameters are not typical of normal borehole operations (the pipe is considerably thicker than most drill pipe and the formation density is higher than typical formations). This was done for numerical stability. The parameters that are out of the typical operating range actually have little effect on the Stoneley wave speed and Q.

Wave properties from FIGS. 7 and 8 were used along with the following relations to calculate the transmission coefficient for Stoneley waves through a section of pipe bounded by two pipe joints:

$$Tf_1 = \frac{2*a_2}{a_1+a_2}, \quad \text{Eq. (4)}$$

$$Tf_2 = \frac{2*a_1}{a_1+a_2}, \quad \text{Eq. (5)}$$

$$Rf_1 = \frac{a_1-a_2}{a_1+a_2}, \text{ and} \quad \text{Eq. (6)}$$

$$Rf_2 = -\frac{a_1-a_2}{a_1+a_2}, \quad \text{Eq. (7)}$$

where $Tf_1$ is the transmission coefficient from a pipe having an internal area of $a_1$ to a pipe having an internal area of $a_2$; $Tf_2$ is the transmission coefficient from a pipe having an internal area of $a_2$ to a pipe having an internal area of $a_1$; $Rf_1$ is the reflection coefficient for a wave traveling in a pipe of internal area $a_1$ being reflected off of a pipe having an internal area of $a_2$; and $Rf_2$ is the reflection coefficient for a wave traveling in a pipe of internal area $a_2$ being reflected off of a pipe having an internal area of $a_1$. The term f in $Tf_1$, $Tf_2$, $Rf_1$ and $Rf_2$ refers to "forward" traveling waves, that is waves traveling in a specified direction. Similar relations can be written for waves traveling in the opposite direction. "b" will be used for these terms.

When these results are combined, and propagation is taken into account, the effect of multiple reflections when propagating across a tool joint (i.e. a connection between one span of pipe and another) can be calculated, and it can be shown that for sequential nodes i and i+1, the composite properties are given by:

$$Tf_{Composite} = \frac{Tf_i \cdot Tf_{i+1} \cdot e^{j \cdot k_i \cdot (z_{i+1}-z_i)}}{1 - Rf_{i+1} \cdot Rb_i \cdot e^{2j \cdot k_k \cdot (z_{i+1}-z_i)}}, \quad \text{Eq. (8)}$$

$$Rf_{Composite} = Rf_i + Tf_i \cdot Tb_i \cdot Rf_{i+1} \cdot e^{2j \cdot k_i \cdot (z_{i+1}-z_i)} \cdot \frac{1}{1 - e^{2j \cdot k_i \cdot (z_{i+1}-z_i)} \cdot Rb_i \cdot Rf_{i+1}}, \quad \text{Eq. (9)}$$

-continued $$Tb_{Composite} = \frac{Tb_i \cdot Tb_{i+1} \cdot e^{-j \cdot k_i \cdot (z_{i+1} - z_i)}}{1 - Rf_{i+1} \cdot Rb_i \cdot e^{-2j \cdot k_k \cdot (z_{i+1} - z_i)}}, \text{ and} \quad \text{Eq. (10)}$$

$$Rf_{Composite} = Rb_{i+1} + Tb_{i+1} \cdot Tf_{i+1} \cdot Rb_i \cdot e^{2j \cdot k_i \cdot (z_{i+1} - z_i)} \cdot \frac{1}{1 - e^{2j \cdot k_i \cdot (z_{i+1} - z_i)} \cdot Rf_{i+1} \cdot Rb_i} \quad \text{Eq. (11)}$$

with $j=\sqrt{-1}$, and it is assumed that z is the drift coordinate along the system, and that diameter changes occur at locations $z_i$ and $z_{i+1}$. It was also assumed that the pipe is sufficiently thick that the outer diameter of the pipe has little effect on the propagation of Stoneley waves, which is a good approximation for any embodiment of a Stoneley wave telemetry system in a drillstring.

Figure 9:
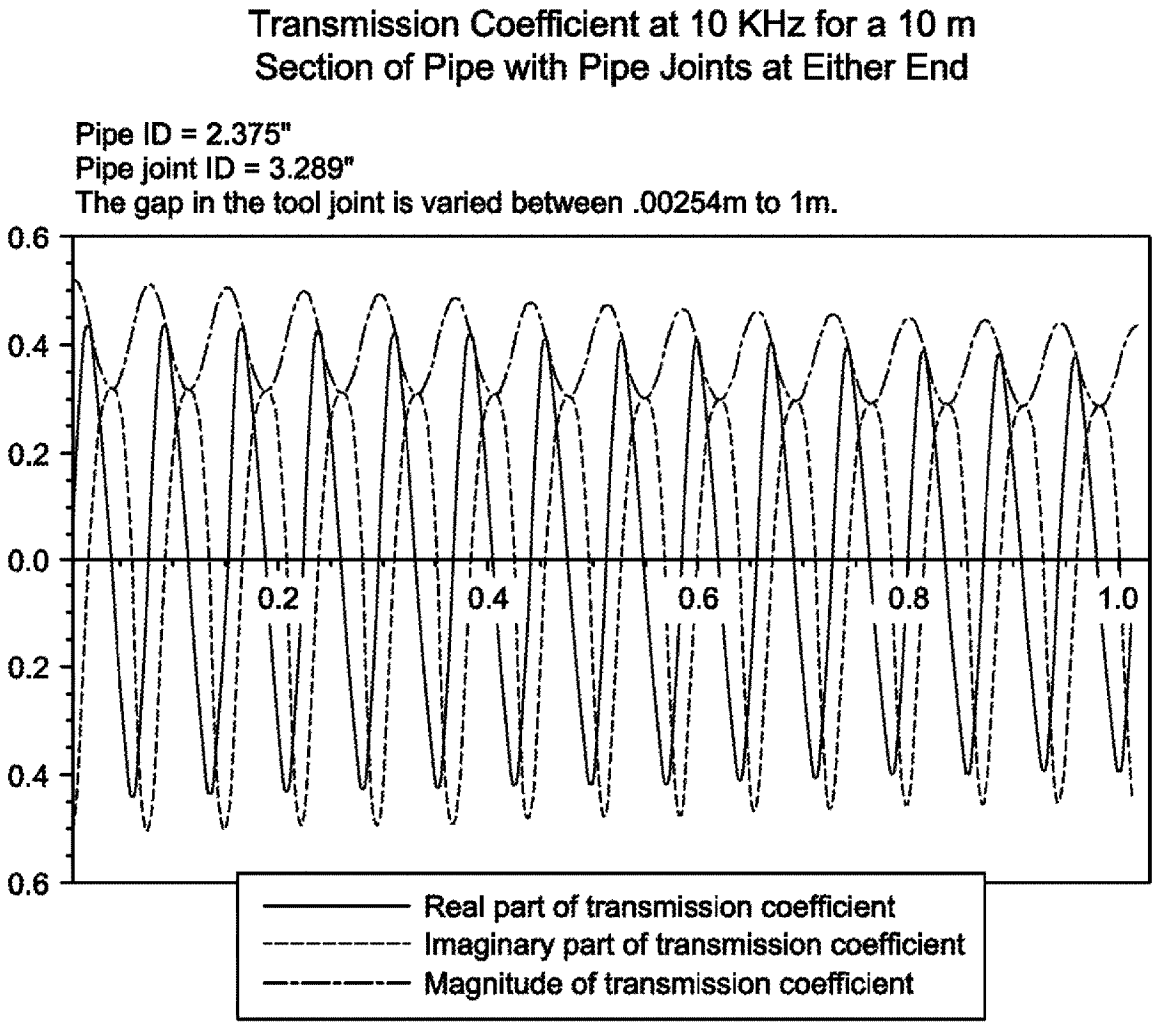
FIGS. 9-11 are graphs plotting various transmission coefficients for various pipes, according to certain embodiments of the present disclosure.
Figure 10:
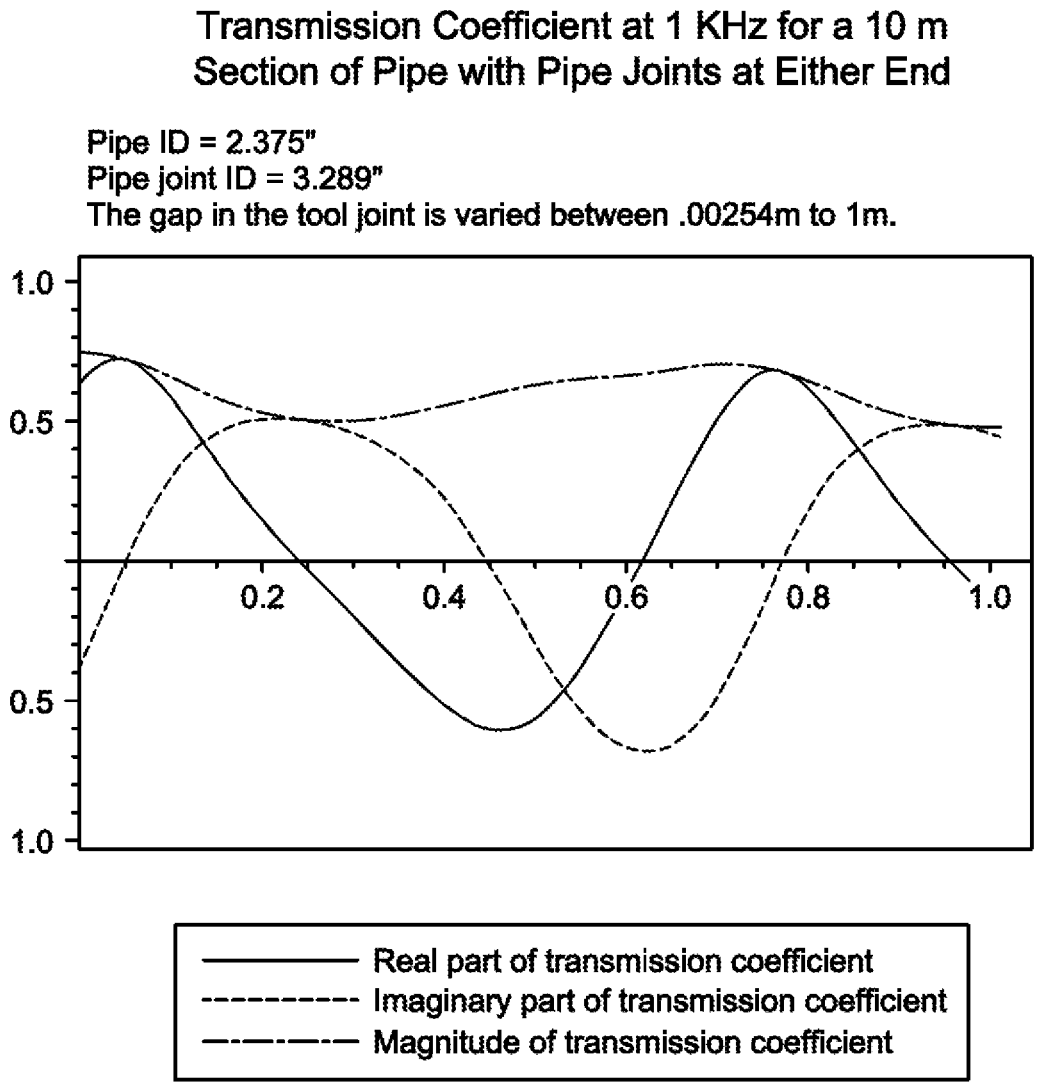

These relations make it possible to compare the effects of reflections at pipe joints with those simply due to propagation. Since Stoneley waves propagating along a borehole are promptly attenuated by a crack in the borehole, it might be supposed that Stoneley waves propagating within a drill pipe would be severely attenuated at pipe joints due to the change in internal diameter at pipe joints. This turns out not to be the case. Referring to FIG. 9, the real part, the imaginary part and the magnitude of the transmission coefficient are shown for a 10 m section of pipe with pipe joints at each end and a frequency of 10 KHz as a function of the length of the region in the pipe joint where the area is different from that in the pipe. For FIG. 10, at 1 KHz for a 10 m section, the ID of the pipe is 2.375", the ID of a pipe joint is 3.289" and the length of the region of the pipe joint varies from 0.00254 m to 1 m. It is clear that the pipe joint has an overall effect on the phase of a signal and can have some effect on the magnitude.

Figure 11:
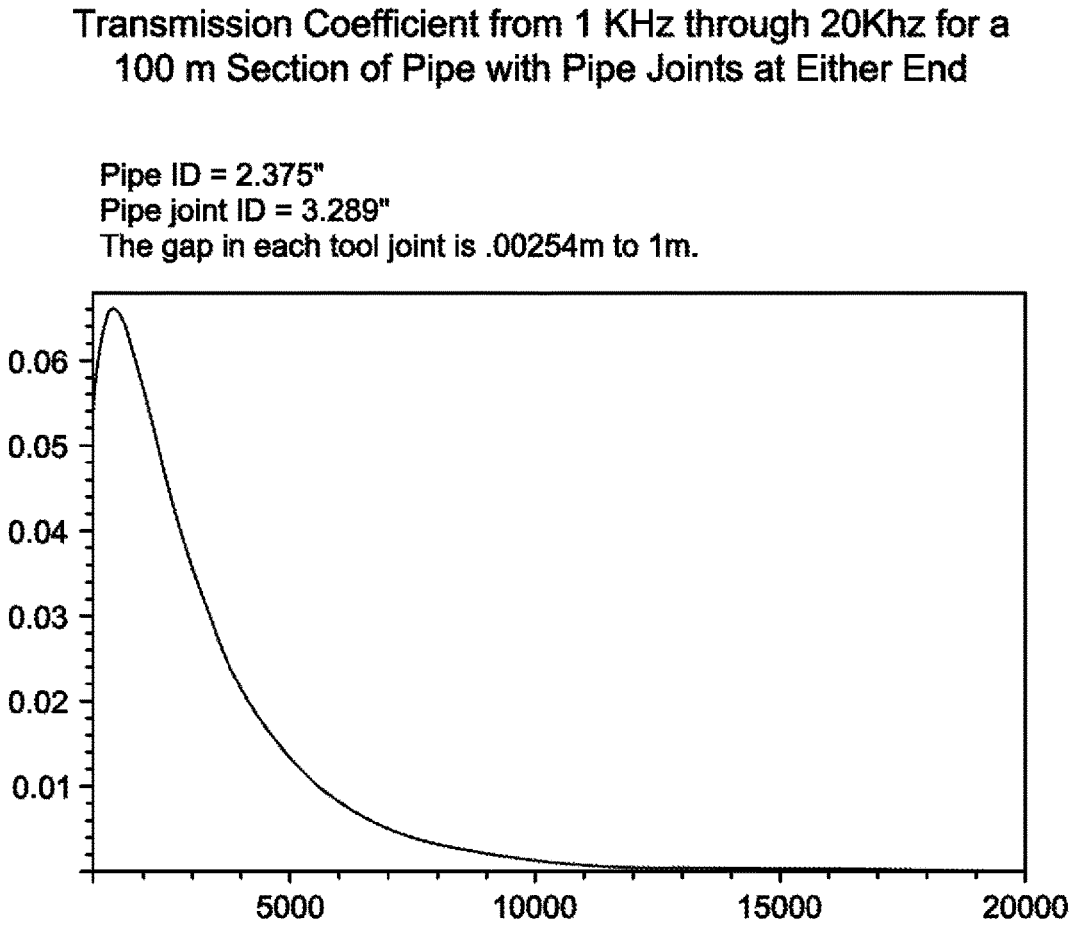

In this case, a Stoneley wave would be attenuated by a factor of between about 0.3 and 0.5 with the overall attenuation increasing noticeably with the length of the pipe joint. Further study reveals that the increase in overall attenuation has little to do with the fact that there is a pipe joint and instead is due to the overall increase of the system as the pipe joint length is increased. This is even evident at 1 KHz, as shown in FIG. 11, where the transmission for a 100 m span of pipe bounded at each end by 0.00254 m (0.1") of pipe joint is plotted from 1 KHz out to 20 KHz. From this plot, it is clear that Stoneley wave telemetry cannot be maintained over long distances without repeaters. However, the use of Stoneley waves for short hop telemetry (over a few tens of meters, e.g., 10-40 meters) without repeaters is feasible.

Therefore, in certain illustrative embodiments of the present disclosure, a short hop telemetry system may be used, for example, to telemeter information from a point within or above a drill bit past a mud motor or rotary steerable device to a module above the mud motor or rotary steerable device. It may also be used to pass information gathered within a mud motor or rotary steerable device to a module above the mud motor or rotary steerable device. The type of information that may be telemetered pertains to, for example, the condition of the mud motor or rotary steerable device, the condition of the drill bit, drilling vibration, torque, weight on bit, bending, mud properties or formation properties.

Figure 12:
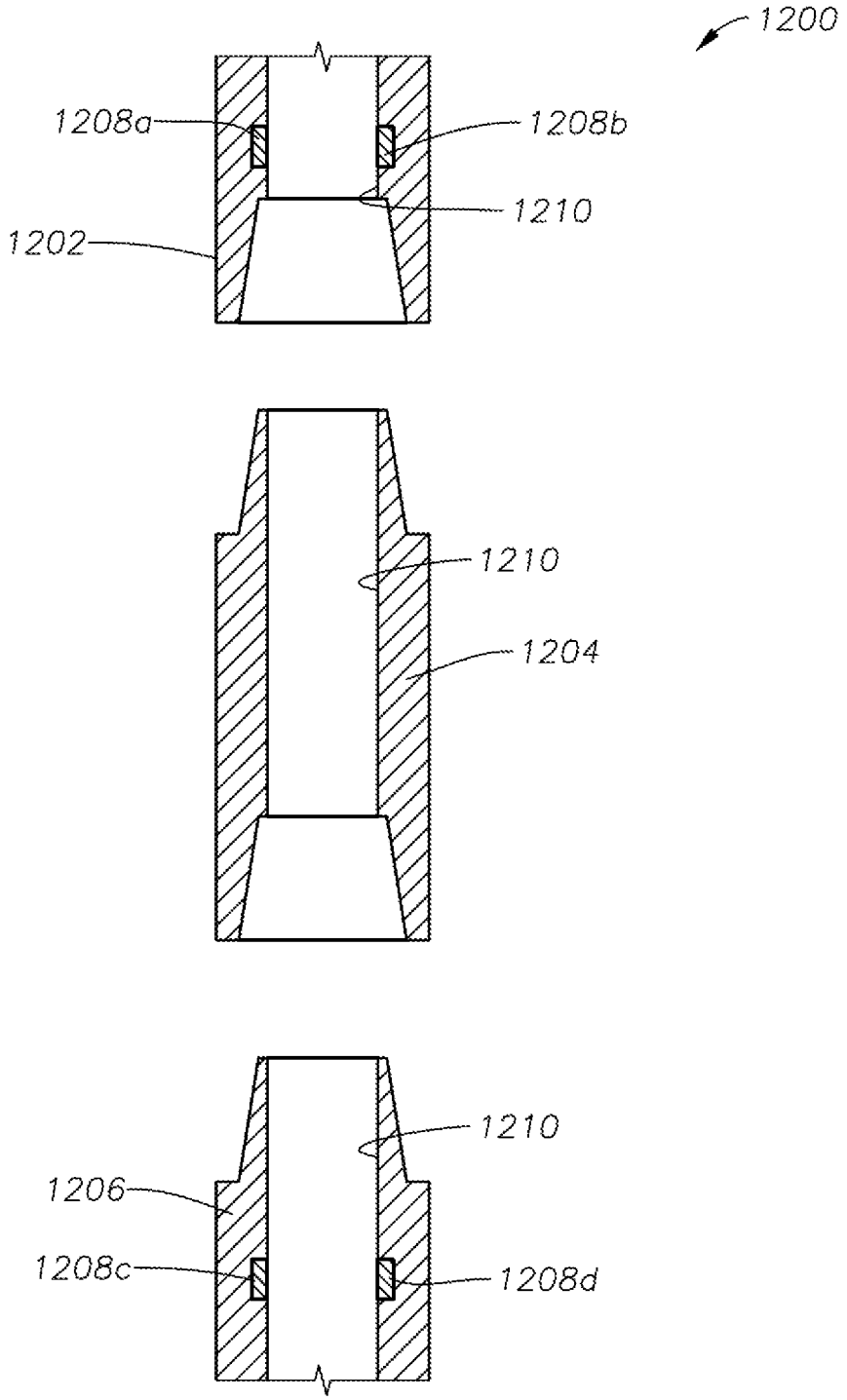
FIG. 12 illustrates a tubular used in a short hop telemetry system, according to certain embodiments of the present disclosure.

Elements of one illustrative embodiment of a tubular used in a short hop telemetry system according to the present disclosure are shown in FIG. 12. Here, tubular 1200 is shown in its individual parts which include a first repeater (i.e., a transceiver having a transmitter and receiver) 1202, intervening tubular or device 1204, and second repeater 1206 (jointly forming a "tubular housing"). First and second repeaters 1202,1206 consist of transducers 1208*a-d* positioned along an inner wall 1210 of tubular 1200 suitable for transmission and reception of Stoneley waves. In addition, transducers 1208*a-d* may be set up in a pattern and operated such that transmission and/or reception is synchronized. Accordingly, during a downlink operation, for example, first repeater 1202 may transmit a Stoneley wave through intervening tubular 1204, where it is received by second repeater 1206. Once received, second repeater 1206 decodes, processes and/or retransmits the signal to another repeater or, alternatively, back to first repeater 1202.

As was noted above, a Stoneley wave telemetry system cannot be operated over long distances without making use of repeaters. An inherent property of most, if not all other telemetry systems making use of a large number of repeaters is high latency, that is a large delay in the transmission of data, even if a suitable data rate is obtained for continuous transmission. This is due to the need at each repeater to receive packets of information and retransmit them from a location near the receiver. Even if retransmission is somehow effected in real time in a different frequency band from the band of the received signal, it is very difficult to obtain suitable isolation between the transmitter and receiver to allow simultaneous operation of both.

In certain illustrative embodiments of the present disclosure, one solution is to receive a packet of information, decode it and then retransmit it. This has the advantage of removing noise that was introduced into the received signal, but it is achieved at the cost of system latency. Although this might be tolerable in certain applications, others may require more speed. Therefore, alternate embodiments of the present disclosure are described below.

Figure 13:
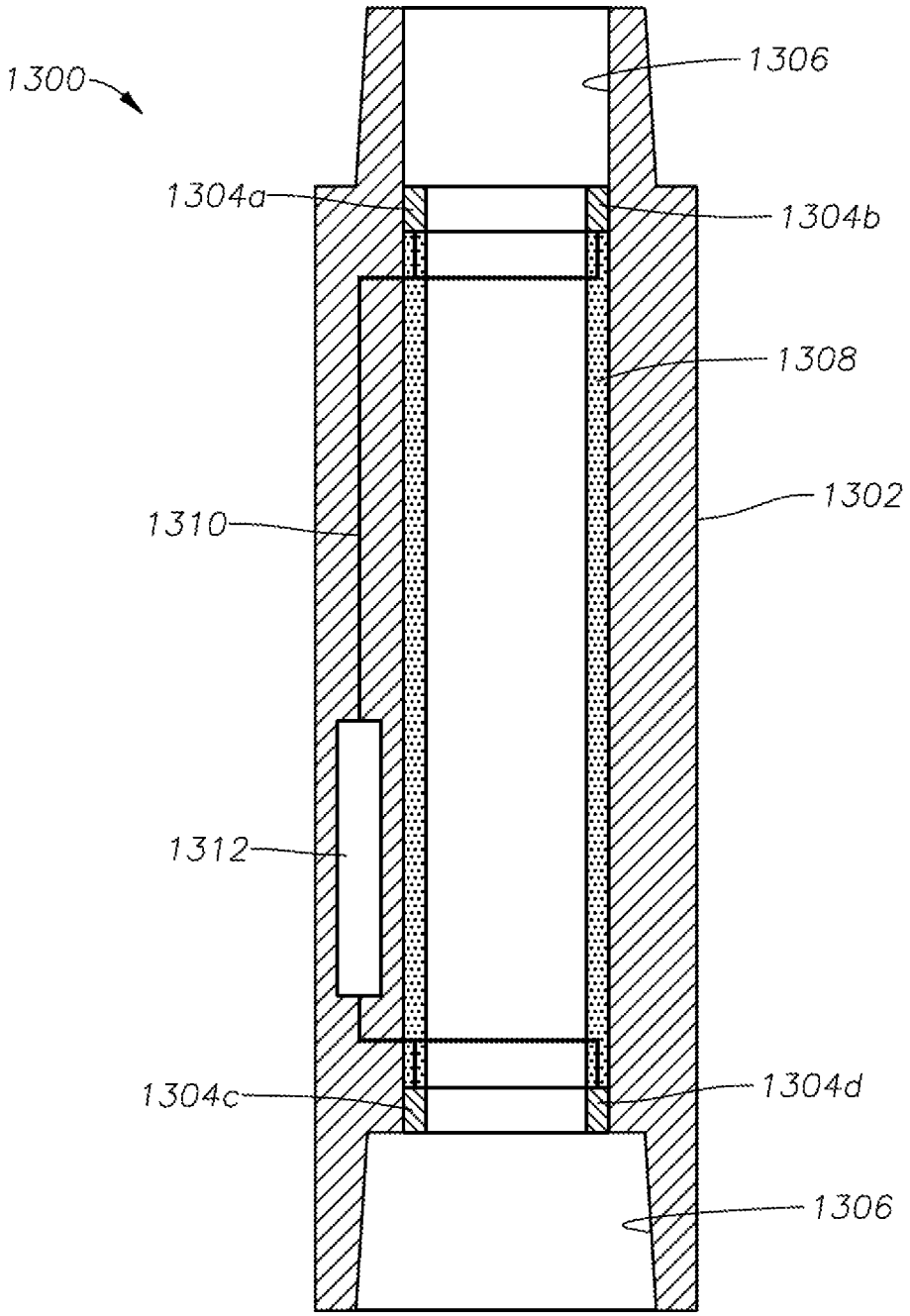
FIG. 13 illustrates a Stoneley wave repeater having an absorber, according to certain illustrative embodiments of the present disclosure.

Stoneley waves have a property that can be exploited in order to work around the system latency problem. As will be understood by those ordinarily skilled in the art having the benefit of this disclosure, Stoneley waves are absorbed by porous media. This effect is typically observed in acoustic logging, as discussed in "Stoneley-wave attenuation and dispersion in permeable formations," Andrew N. Norris, Geophysics, Vol. 54, No. 3 (March 1989): P. 330-341. Thus, in certain embodiments described herein, this same effect is exploited to isolate the transmitter and receiver in a Stoneley wave telemetry repeater. An embodiment of such a repeater is illustrated in FIG. 13, which is a sectional view of a single repeater housed in a sub. Repeater 1300 can be either bi-directional or only pass signals in one direction. In addition, repeater 1300 may be full- or half-duplex, as will be described later.

Repeater 1300 includes a tubular housing 1302 having a first and second end. In certain embodiments, repeater 1302 may be housed in a section of drill collar. Transducers 1304*a-d* are mounted on both ends of repeater 1300 along its inner wall 1306. Transducers 1304*a-d* may be arranged for synchronous operation, as described earlier. For bi-directional capability, transducers 1304*a-d* can be transceivers, such as piezoelectric or magnetostrictive devices, or separate elements may be dedicated to up-link and down-link operation. Transducers 1304*a-d* are communicably coupled to one another using, for example, wiring 1310. As will be described in greater detail below, electronics and power module 1312 is also coupled along wiring 1310 in order to provide various functions, such as, for example, amplification, filtering, and/or processing of Stoneley wave signals.

In certain illustrative embodiments of the present disclosure, inner wall 1306 is lined with a Stoneley wave absorber

1308, such as, for example, a compliant and porous material. The porous and compliant properties of Stoneley wave absorber 1308 makes it possible to receive a Stoneley wave telemetry signal, boost its amplitude and perform simple filtering or processing in real time, and retransmit the signal in the same direction without saturating the receiver. Stoneley wave absorber 1308 is positioned between transducers 1304*a,b* at the first end and transducers 1304*c,d* at the second end of tubular 1302. Stoneley wave absorber 1308 may be bonded to inner wall 1306 of tubular 1302 or hung from a sleeve within tubular 1302.

In certain embodiments, the porous material is also permeable, that is the porosity is connected. It may consist of a substance such as Viton, carboxylated nitrile, neoprene, or a large number of other rubbers including silicon rubbers. It should be fabricated such that it is porous, such that the porosity is connected throughout most of the material, and with pores of sufficient size that packing off by lost circulation material or mud particulates is minimal. An illustrative mean diameter of porous inclusions would be in the range of about 0.1 mm to about 0.5 mm. A porous material can be fabricated by starting with a distribution of spheres, ellipsoids or similarly shaped objects made of the rubber and fusing them. The very low Young's modulus of the rubber in comparison to the Young's modulus of the drill collar material, coupled with the porosity should make it a good absorber of Stoneley waves. For example, the Young's modulus of Viton is about 4.6 M Pa, while that of typical drill collar material is on the order of 300,000 m Pa (e.g. 6140 steel).

Figure 14:
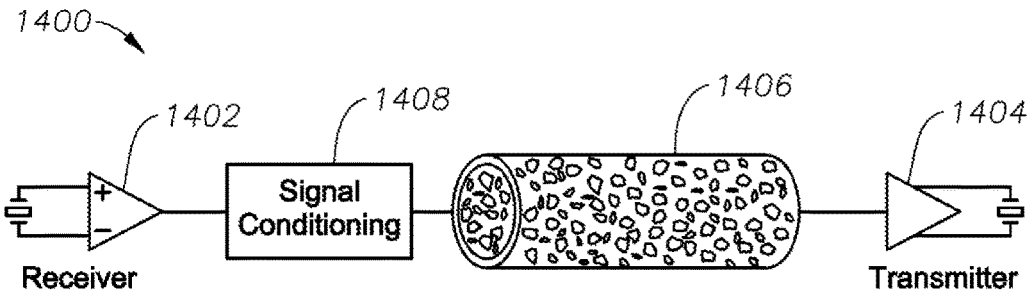
FIG. 14 is a basic conceptual view of a single Stoneley wave repeater, according to certain illustrative embodiments of the present disclosure.

FIG. 14 is a basic conceptual view of a single Stoneley wave repeater, according to certain illustrative embodiments of the present disclosure. Here, a Stoneley wave repeater includes transducers which form a receiver 1402 and transmitter 1404. Stoneley wave absorber 1406 is positioned between transmitter 1404 and receiver 1402. In addition, a signal conditioner is communicably coupled between receiver 1402 and transmitter 1404 in order to condition the Stoneley wave signal received by receiver 1402, and then send the conditioned signal on to transmitter 1404 where it is retransmitted. For example, signal conditioner 1408 may amplify, filter (e.g., noise), or otherwise process the Stoneley wave signal.

Figure 15:
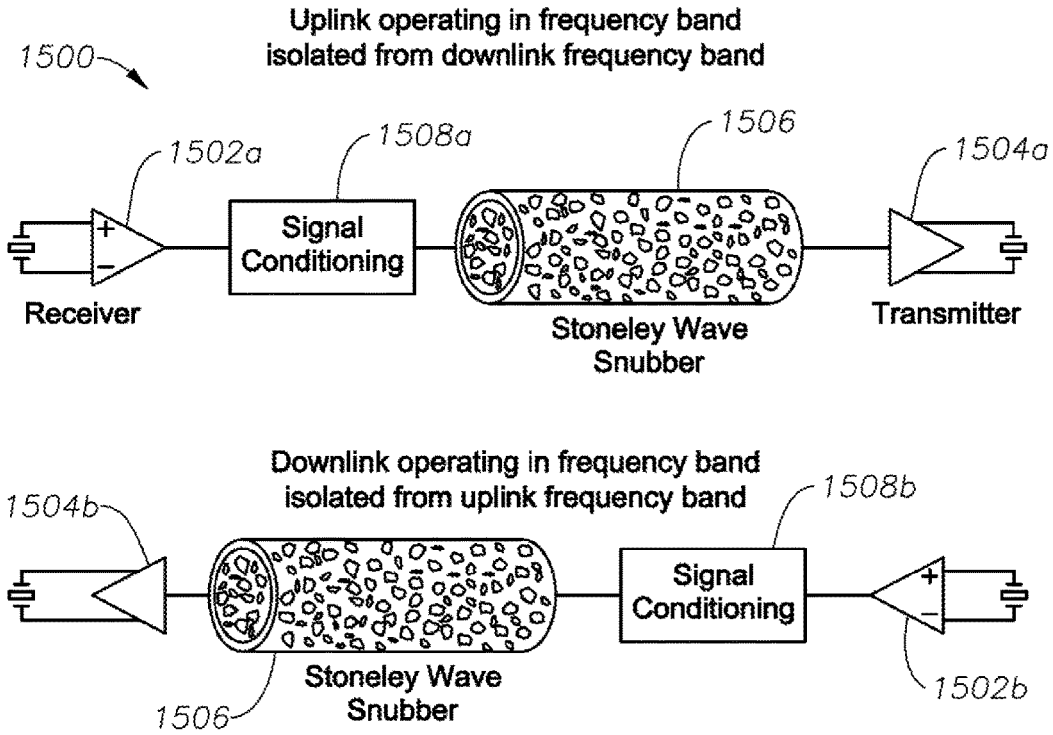
FIGS. 15 and 16 are conceptual views of a full and half-duplex repeater, respectively, according to certain illustrative embodiments of the present disclosure.
Figure 16:
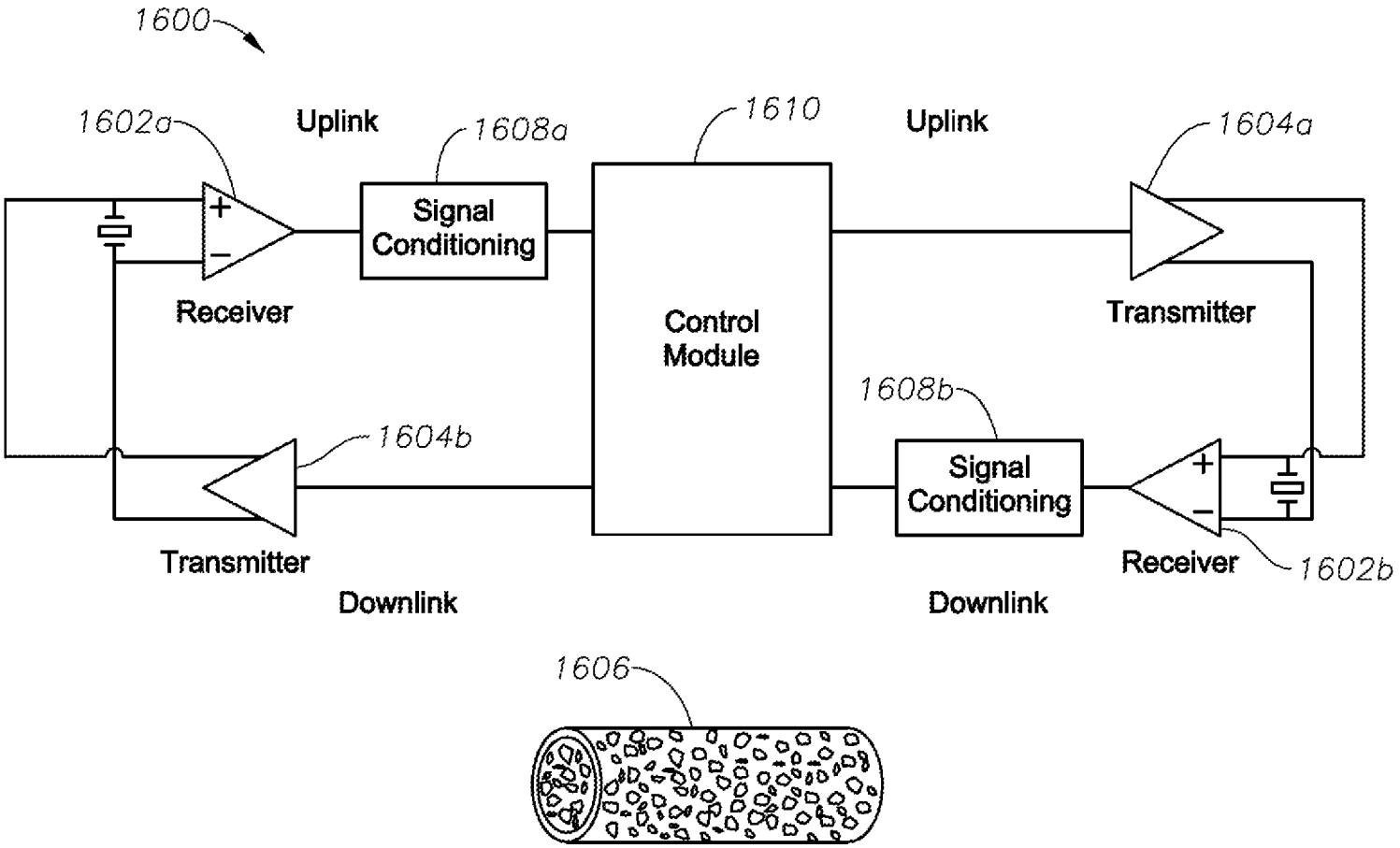

FIGS. 15 and 16 are conceptual views of a full and half-duplex repeater, respectively, according to certain illustrative embodiments of the present disclosure. FIGS. 15 and 16 illustrate both the uplink and downlink modes. FIG. 15 shows the full-duplex operation in which uplink and downlink communications may occur simultaneously, while the half-duplex embodiment of FIG. 16 may only communicate in the uplink or downlink mode at a given time. In FIG. 15, although two Stoneley wave absorbers 1506, in reality there is a single absorber 1506 common to both the uplink and the downlink modes.

In FIG. 15, the uplink and downlink modes are operated in isolated frequency bands. Similar to the embodiment of FIG. 14, Stoneley wave repeater 1500 includes an uplink receiver 1502*a*, signal conditioner 1508*a*, Stoneley wave absorber 1506 and transmitter 1504*a*. Stoneley wave repeater 1500 also includes a downlink receiver 1502*b*, signal conditioner 1508*b*, Stoneley wave absorber 1506 and transmitter 1504*b*. Signal conditioners 1508*a,b* perform conditioning of the uplink and downlink Stoneley wave signals, as previously described. In the full-duplex system, the absorber keeps the uplink from interfering with itself and the downlink from interfering with itself. The uplink and downlink are isolated from each other by operating them in widely separated frequency bands and making use of standard filtering techniques. Accordingly, Stoneley wave repeater 1500 may operate in the uplink or downlink modes.

In FIG. 16, half-duplex Stoneley wave repeater 1600 includes many of the same components as previous embodiments. Stoneley wave absorber 1606 again keeps the uplink from interfering with itself and the downlink from interfering with itself. In uplink mode, the transducer(s) on one end are receiver(s) 1602*a* and the transducer(s) on the other end are transmitter(s) 1604*b*. When repeater 1600 operates in downlink mode, the transducers change roles. That is, the transducer(s) that acted as receiver(s) in the uplink mode now act as transmitter(s) 1604*b* and the transducer(s) that acted as transmitter(s) in the uplink mode now act as receiver(s) 1602*b*. Switching between the modes is carried out using a control module 1610. Several means for switching between uplink and downlink are possible. For example, the control module may give control to the first input with a signal level above a pre-specified threshold.

Figure 17:
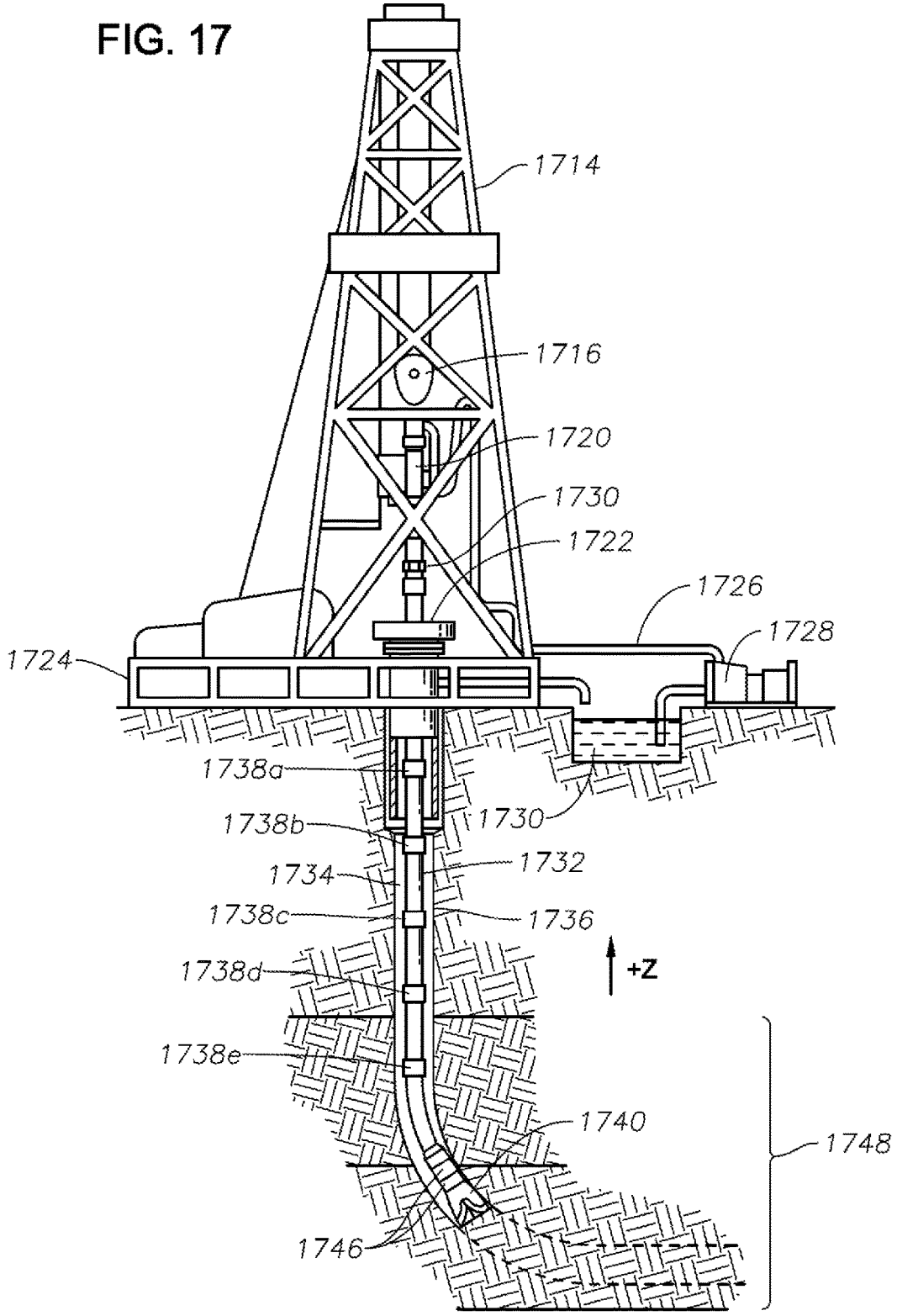
FIG. 17 shows a drilling environment in which the present disclosure may applied, according to certain illustrative embodiments of the present disclosure.

FIG. 17 shows a drilling environment in which the present disclosure may applied, according to certain illustrative embodiments of the present disclosure. The drilling environment includes a drilling platform 1724 that supports a derrick 1715 having a traveling block 1717 for raising and lowering a drill string 1732. A drill string kelly 1720 supports the rest of drill string 1732 as it is lowered through a rotary table 1722. Rotary table 1722 rotates drill string 1732, thereby turning drill bit 1740. As bit 1740 rotates, it creates a borehole 1736 that passes through various formations 1748. A pump 1728 circulates drilling fluid through a feed pipe 1726 to kelly 1720, downhole through the interior of drill string 1732, through orifices in drill bit 1740, back to the surface via annulus 1734 around drill string 1732, and into a retention pit 1730. The drilling fluid transports cuttings from borehole 1736 into pit 1730 and aids in maintaining the integrity of borehole 1736. Various materials can be used for drilling fluid, including oil-based fluids and water-based fluids.

As shown, logging tools 1746 may be integrated into a bottom-hole assembly near drill bit 1740. As drill bit 1740 extends the borehole 1736 through formation 1748, logging tools 1746 may collect measurements relating to various formation properties, as well as the tool orientation and various other drilling conditions. Each of logging tools 1746 may take the form of a drill collar, i.e., a thick-walled tubular that provides weight and rigidity to aid the drilling process.

Moreover, as described herein, a plurality of Stoneley wave telemetry devices 1738*a-e* may positioned along drill string 1732 in order to conduct downhole telemetry operations. In the illustrated embodiment, telemetry devices 1738*a-e* are repeaters. Stoneley wave repeaters 1738*a-e* may be housed in drill collars that join sections of drill string 1732 together. During telemetry operations, logging or other measurements may be transferred in an uplink or downlink direction using Stoneley wave repeaters 1738*a-e*, as previously described herein. As an example, the Stoneley wave-based techniques described herein may communicate logging measurements to a surface receiver 1730 and/or receive commands from the surface. Moreover, in other embodiments, telemetry devices 1738*a-e* may be a transmitter or receiver only, thereby allowing uni-directional communication between transmitter-receiver pairs.

Embodiments described herein further relate to any one or more of the following paragraphs:

1. A well system for downhole telemetry, the well system comprising a tubular string adapted to be positioned along a borehole extending within a formation; and a plurality of Stoneley wave telemetry devices positioned along the tubular string to communicate Stoneley waves between each other.

2. A well system as defined in paragraph 1, wherein the Stoneley wave telemetry devices are positioned within drill collars along the tubular string.

3. A well system as defined in any of paragraphs 1 or 2, wherein the Stoneley wave telemetry devices are receivers, transmitters or repeaters.

4. A well system as defined in any of paragraphs 1-3, wherein the Stoneley wave repeaters each comprise: a tubular housing; at least one transducer at a first end of the tubular housing; and at least one transducer at a second end of the tubular housing opposite the first end.

5. A well system as defined in any of paragraphs 1-4, wherein the transducers at the first and second end of the tubular housing each comprise two radially opposed transducers.

6. A well system as defined in any of paragraphs 1-5, wherein the two transducers are synchronized.

7. A well system as defined in any of paragraphs 1-6, wherein the transducers are piezo-electric or magnetostrictive elements.

8. A well system as defined in any of paragraphs 1-7, wherein the Stoneley wave telemetry devices are repeaters; and the well system is a short hop telemetry system.

9. A well system as defined in any of paragraphs 1-8, wherein the Stoneley wave repeaters are separated from each other by a distance 10-40 meters.

10. A well system as defined in any of paragraphs 1-9, further comprising a Stoneley wave absorber positioned between the at least one transducer at the first end and the at least one transducer at the second end of the tubular housing.

11. A well system as defined in any of paragraphs 1-10, wherein the Stoneley wave absorber is bonded to an inner wall of the tubular housing.

12. A well system as defined in any of paragraphs 1-11, wherein the Stoneley wave absorber is sleeve positioned along an inner wall of the tubular housing.

13. A well system as defined in any of paragraphs 1-12, wherein the Stoneley wave absorber comprises a porous material.

14. A well system as defined in any of paragraphs 1-13, further comprising a signal conditioner communicably coupled between the at least one transducer at the first end and the at least one transducer at the second end of the tubular housing, wherein the signal conditioner is configured to perform at least one of an amplification, filtering or processing of Stoneley wave signals.

15. A well system as defined in any of paragraphs 1-14, wherein the well system is a full duplex telemetry system.

16. A well system as defined in any of paragraphs 1-15, wherein the well system is a half duplex telemetry system; and the well system further comprises a control module communicably coupled between the at least one transducer at the first end and the at least one transducer at the second end of the tubular housing, to thereby switch the Stoneley wave repeaters between an uplink and downlink mode.

17. A method for downhole telemetry, the method comprising using a first telemetry device to transmit Stoneley waves along a tubular string extending inside a borehole positioned in a formation; and receiving the Stoneley waves at a second telemetry device positioned along the tubular string, thereby conducting a telemetry operation using the first and second telemetry devices.

18. A method as defined in paragraph 17, wherein the telemetry devices are transmitters, receivers, or repeaters.

19. A method as defined in paragraphs 17 or 18, wherein the first and second repeaters each comprise a plurality of transducers; and the method further comprising synchronously transmitting or receiving the Stoneley waves using the transducers.

20. A method as defined in any of paragraphs 17-19, wherein receiving the Stoneley waves further comprises cancelling noise from the received Stoneley waves.

21. A method as defined in any of paragraphs 17-20, wherein cancelling the noise comprises subtracting signals from radially opposing transducers which form part of the second telemetry device.

22. A method as defined in any of paragraphs 17-21, wherein receiving the Stoneley waves further comprises amplifying the received Stoneley waves.

23. A method for downhole telemetry, comprising using Stoneley waves as carrier signals for a downhole telemetry operation.

24. A method as defined in paragraph 23, further comprising performing a short hop telemetry operation using the Stoneley carrier signals.

25. A method as defined in paragraphs 23 or 24, wherein a full duplex telemetry operation is conducted.

26. A method as defined in any of paragraphs 23-25, wherein a half duplex telemetry operation is conducted.

Although various embodiments and methodologies have been shown and described, the disclosure is not limited to such embodiments and methodologies and will be understood to include all modifications and variations as would be apparent to one skilled in the art. Therefore, it should be understood that embodiments of the disclosure are not intended to be limited to the particular forms disclosed. Rather, the intention is to cover all modifications, equivalents and alternatives falling within the spirit and scope of the disclosure as defined by the appended claims.

What is claimed is:

1. A well system for downhole telemetry, the well system comprising:

a tubular string adapted to be positioned along a borehole extending within a formation; and a plurality of Stoneley wave telemetry receivers, transmitters or repeaters positioned along the tubular string to communicate Stoneley waves between each other, wherein the Stoneley wave repeaters each comprise:

a tubular housing;

at least one transducer at a first end of the tubular housing; and at least one transducer at a second end of the tubular housing opposite the first end, wherein the transducers at the first and second end of the tubular housing each comprise two radially opposed transducers.

2. A well system as defined in claim 1, wherein the Stoneley wave telemetry devices are positioned within drill collars along the tubular string.

3. A well system as defined in claim 1, wherein the two transducers are synchronized.

4. A well system as defined in claim 1, wherein the transducers are piezo-electric or magnetostrictive elements.

5. A well system as defined in claim 1, wherein:

the Stoneley wave telemetry repeaters are part of a short hop telemetry well system.

6. A well system as defined in claim 5, wherein the Stoneley wave repeaters are separated from each other by a distance 10-40 meters.

7. A well system as defined in claim 1, further comprising a Stoneley wave absorber positioned between the at least one transducer at the first end and the at least one transducer at the second end of the tubular housing.

8. A well system as defined in claim 7, wherein the Stoneley wave absorber is bonded to an inner wall of the tubular housing.

9. A well system as defined in claim 7, wherein the Stoneley wave absorber is sleeve positioned along an inner wall of the tubular housing.

10. A well system as defined in claim 7, wherein the Stoneley wave absorber comprises a porous material.

11. A well system as defined in claim 7, further comprising a signal conditioner communicably coupled between the at least one transducer at the first end and the at least one transducer at the second end of the tubular housing, wherein the signal conditioner is configured to perform at least one of an amplification, filtering or processing of Stoneley wave signals.

12. A well system as defined in claim 7, wherein the well system is a full duplex telemetry system.

13. A well system as defined in claim 7, wherein:

the well system is a half duplex telemetry system; and the well system further comprises a control module communicably coupled between the at least one transducer at the first end and the at least one transducer at the second end of the tubular housing, to thereby switch the Stoneley wave repeaters between an uplink and downlink mode.

14. A method for downhole telemetry, the method comprising:

using a first telemetry device to transmit Stoneley waves along a tubular string extending inside a borehole positioned in a formation;

receiving the Stoneley waves at a second telemetry device positioned along the tubular string, thereby conducting a telemetry operation using the first and second telemetry devices; and cancelling noise from the received Stoneley waves by subtracting signals from radially opposing transducers which form part of the second telemetry device.

15. A method as defined in claim 14, wherein the telemetry devices are transmitters, receivers, or repeaters.

16. A method as defined in claim 15, wherein:

the first and second repeaters each comprise a plurality of transducers; and the method further comprising synchronously transmitting or receiving the Stoneley waves using the transducers.

17. A method as defined in claim 14, wherein receiving the Stoneley waves further comprises amplifying the received Stoneley waves.

18. A method as defined in claim 14, further comprising using Stoneley waves as carrier signals for a downhole telemetry operation.

19. A method as defined in claim 18, further comprising performing a short hop telemetry operation using the Stoneley carrier signals.

20. A method as defined in claim 18, wherein a full duplex telemetry operation is conducted.

21. A method as defined in claim 18, wherein a half duplex telemetry operation is conducted.

* * * * *